US012048389B2

(12) United States Patent
Vernooij

(10) Patent No.: US 12,048,389 B2
(45) Date of Patent: Jul. 30, 2024

(54) PANEL HOOK

(71) Applicant: 2SECURE HOLDING B.V., Eindhoven (NL)

(72) Inventor: Johannes Adrianus Maria Vernooij, Eindhoven (NL)

(73) Assignee: 2SECURE HOLDING B.V., Eindhoven (NL)

( * ) Notice: Subject to any disclaimer, the term of this patent is extended or adjusted under 35 U.S.C. 154(b) by 0 days.

(21) Appl. No.: 17/614,622

(22) PCT Filed: May 28, 2020

(86) PCT No.: PCT/NL2020/050342
§ 371 (c)(1),
(2) Date: Nov. 29, 2021

(87) PCT Pub. No.: WO2020/242308
PCT Pub. Date: Dec. 3, 2020

(65) Prior Publication Data

US 2022/0225811 A1 Jul. 21, 2022

(30) Foreign Application Priority Data

May 29, 2019 (NL) ..... 2023234

(51) Int. Cl.
*A47H 13/04* (2006.01)

(52) U.S. Cl.
CPC ..... *A47H 13/04* (2013.01)

(58) Field of Classification Search
CPC ..... A47H 13/04; A47H 15/02
(Continued)

(56) References Cited

U.S. PATENT DOCUMENTS

D56,016 S * 8/1920 Mertz ..... D8/383
1,445,037 A * 2/1923 Poelle ..... A41F 19/00 24/347

(Continued)

FOREIGN PATENT DOCUMENTS

DE 1156209 B 10/1963
DE 1259062 B 1/1968

(Continued)

OTHER PUBLICATIONS

International Preliminary Report on Patentability issued Nov. 16, 2021, for PCT/NL2020/050342 (six (6) pages).

(Continued)

*Primary Examiner* — Emily M Morgan
(74) *Attorney, Agent, or Firm* — KDW Firm PLLC

(57) ABSTRACT

A panel hook configured to hook a panel, such as a curtain, to a carrier, such as a rail. The panel hook includes a panel fastening element configured to fasten the panel to the panel hook by arranging the panel fastening element in a pocket of the panel in an arranging direction, and a hook element arranged on a first outer end of the panel fastening element and configured to hook the panel hook onto the carrier. The panel fastening element includes at a second outer end lying opposite the first outer end a barb configured such that a distance between a free outer end of the barb and the first outer end is at least the same as the dimension of the pocket in the arranging direction.

8 Claims, 3 Drawing Sheets

Figure 1F:
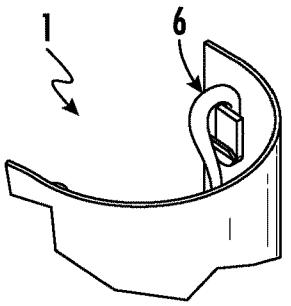
Figure 1E:
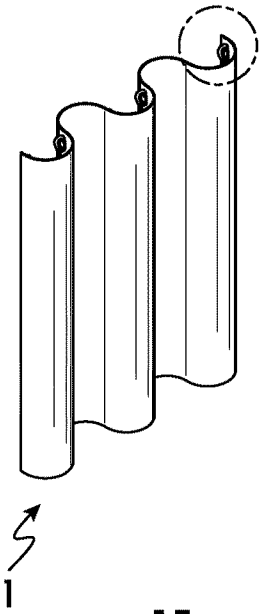
Figure 1C:
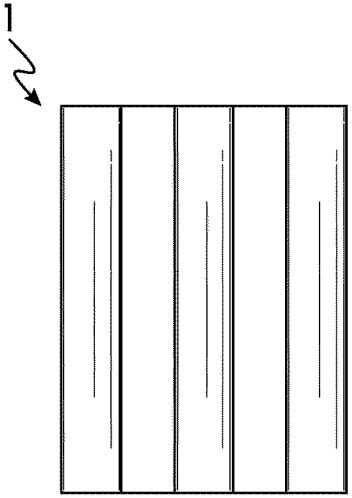
Figure 1D:
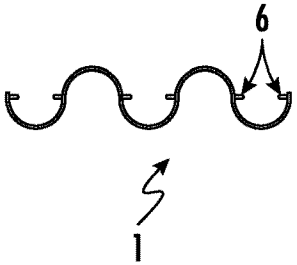
Figure 1B:
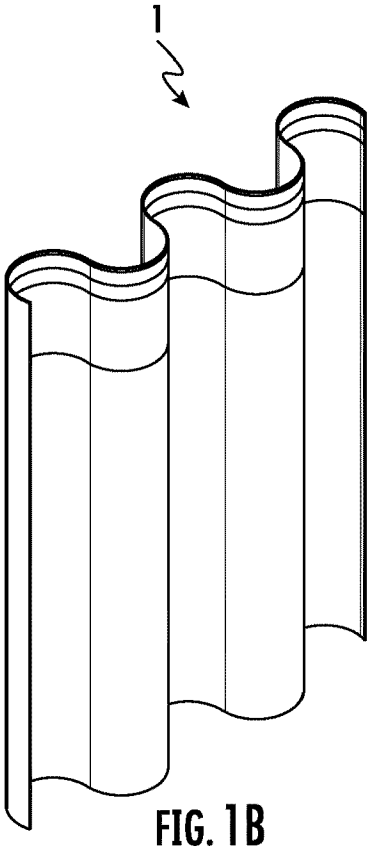
Figure 1A:
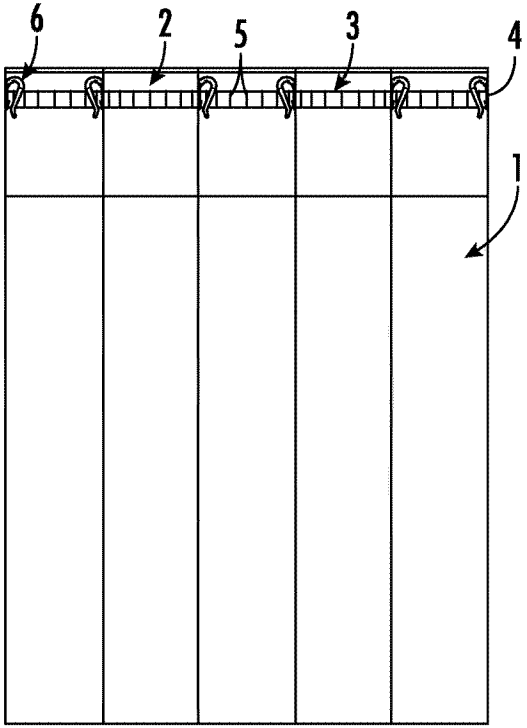
Figure 2C:
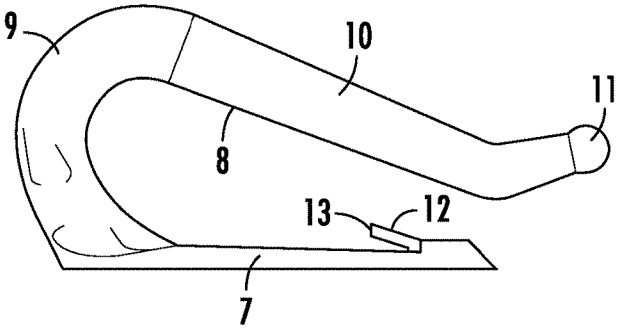
Figure 2F:
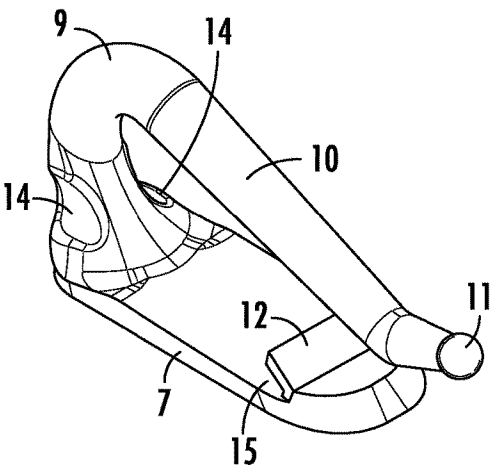
Figure 2B:
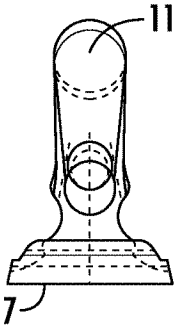
Figure 2E:
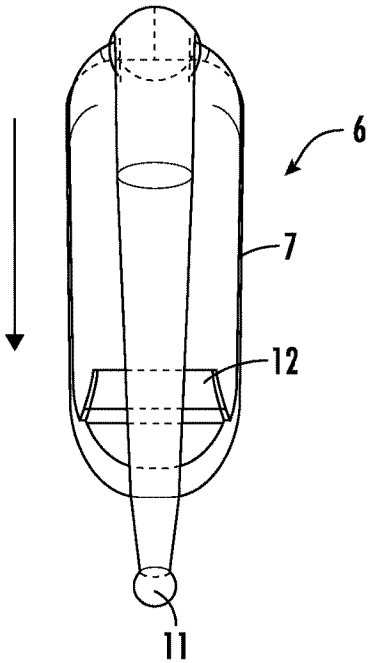
Figure 2A:
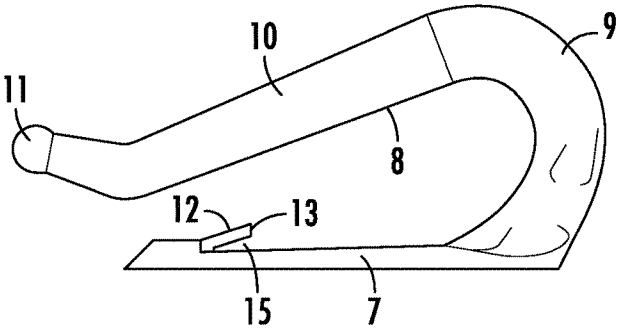
Figure 2D:
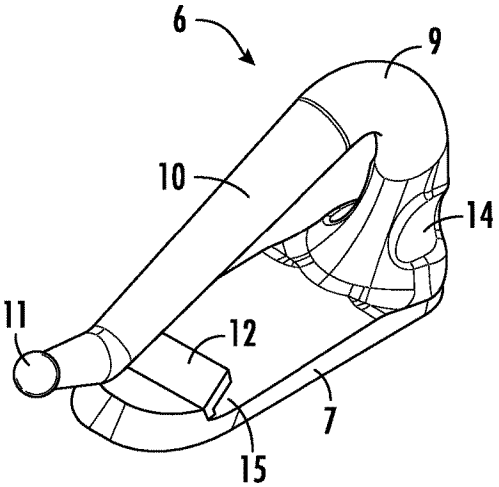

(58) Field of Classification Search
USPC ..... 16/87.2; D8/356, 383, 367, 368, 371; 160/348
See application file for complete search history.

(56) References Cited

U.S. PATENT DOCUMENTS 1,675,281 A * 6/1928 Strand ..... A47G 1/20 D8/371
1,841,061 A * 1/1932 Sarkisian ..... A47H 13/04 24/360
D116,816 S * 9/1939 Dick ..... 452/187
2,332,855 A * 10/1943 Jones ..... F16B 5/121 D8/356
D140,381 S * 2/1945 Anderson ..... D8/356
2,652,586 A * 9/1953 Ramsberger ..... A47H 13/04 16/93 D
2,720,289 A * 10/1955 Henrickson ..... E04B 5/10 411/522
2,760,674 A * 8/1956 Karp ..... B65D 45/16 D8/367
2,897,535 A * 8/1959 Radler ..... A47H 13/01 16/87.2
3,071,938 A * 1/1963 Davidson ..... A44C 7/00 24/600.9
3,349,443 A * 10/1967 Sury ..... A47G 1/0638 248/490
D212,608 S * 11/1968 Levine ..... D8/367
D224,959 S * 10/1972 Dauray ..... D8/367
D234,186 S * 1/1975 Langston ..... D8/367
D283,300 S * 4/1986 Muramatsu ..... D8/356
D315,669 S * 3/1991 Paul ..... D8/367
D356,725 S * 3/1995 McMichael ..... D8/368
D359,230 S * 6/1995 Levine ..... D8/371
D365,014 S * 12/1995 Fennessy ..... D8/371
5,636,417 A * 6/1997 Eisenkolb ..... A47H 13/14 160/346
D439,141 S * 3/2001 Ho ..... D8/367
D535,550 S * 1/2007 Silberman ..... D8/367
D540,659 S * 4/2007 Schmidt ..... D8/367
D626,403 S * 11/2010 Portz ..... D8/367
9,347,468 B2 * 5/2016 Eisenkolb ..... F16B 2/12
D802,402 S * 11/2017 Hintze ..... D8/367
2010/0299870 A1 * 12/2010 Yeh ..... A47K 3/38 16/87.2

FOREIGN PATENT DOCUMENTS

DE 202019102699 U1 5/2019
GB 191015079 A 6/1911

OTHER PUBLICATIONS

International Search Report and Written Opinion for International application No. PCT/NL2020/050342, mailed on Aug. 19, 2020, 9 pages.

* cited by examiner

PANEL HOOK

This application is a national stage filing under 35 U.S.C. 371 of pending International Application No. PCT/NL2020/050342, filed May 28, 2020, which claims priority to Netherlands Patent Application No. NL 2023234, filed May 29, 2019, the entirety of which applications are incorporated by reference herein.

The invention relates to a panel hook configured to hook a panel, such as a curtain, to be connected to the panel hook to a carrier, such as a rail, wherein the panel hook comprises

- a panel fastening element configured to fasten the panel to the panel hook by arranging the panel fastening element in a pocket of the panel in an arranging direction; and
- a hook element arranged on a (first) outer end of the panel fastening element and configured to hook the panel hook onto the carrier.

The invention relates particularly to a panel hook configured to be connected to a tape with pockets which has optionally already been attached to the curtain beforehand. Pockets with a width of for instance 1 centimetre are arranged at a regular distance from each other in the tape, manufactured particularly from woven plastic. The pockets are formed at a distance from each other by arranging a strip on the tape, wherein the panel fastening elements can be inserted into the pockets.

A drawback of the known panel hook is that it must be arranged in the pocket by means of a rotation movement, wherein the hook element is first inserted from below into the pocket and the panel hook is then rotated in the pocket so as to be moved into its final position. Such a complicated movement is laborious and time-consuming in any case, and is not suitable for mechanical (instead of or in addition to manual) arranging of the panel hook.

It is an object of the invention to improve the prior art in the sense of obtaining an improved panel hook which can be mounted in the pocket in simple manner and not just manually, but also mechanically.

A panel hook of the type stated in the preamble has for this purpose the feature according to the invention that the panel fastening element comprises, at a second outer end lying opposite the first outer end, a barb configured such that a distance between a free outer end of the barb and the first outer end is at least the same as the dimension of the pocket in the arranging direction. This specific distance enables the panel hook to be fastened suspended in the pocket in its final position in a notch formed by the barb and the panel fastening element. The panel hook is preferably inserted with its panel fastening element into the pocket in one longitudinal movement, wherein in the final position of the panel fastening element a wall of the pocket particularly lies confined between the barb and the hook element. In other words, at its one free edge the pocket in that case lies confined in the notch formed by the barb and the panel fastening element, and at its other free edge the pocket lies against the hook element. The panel fastening element and the hook element are preferably manufactured integrally, particularly from a piece of plastic.

In a preferred embodiment of a panel hook according to the invention the barb is directed toward the hook element and extends in a direction obliquely opposite to the arranging direction.

In a further preferred embodiment of a panel hook according to the invention the panel fastening element is configured to clamp a wall of the pocket between the barb and the hook element. The panel fastening element is preferably configured to click or snap a wall of the pocket between the barb and the hook element.

In a further preferred embodiment of a panel hook according to the invention the panel fastening element is elongate and extends parallel to the insertion direction. The hook element preferably extends beyond the barb.

The hook element preferably comprises engaging means in the form of two recesses arranged opposite each other in order to enable the panel hook to be engaged mechanically (in centring manner) and then be slid mechanically into the pocket.

Figure 3:
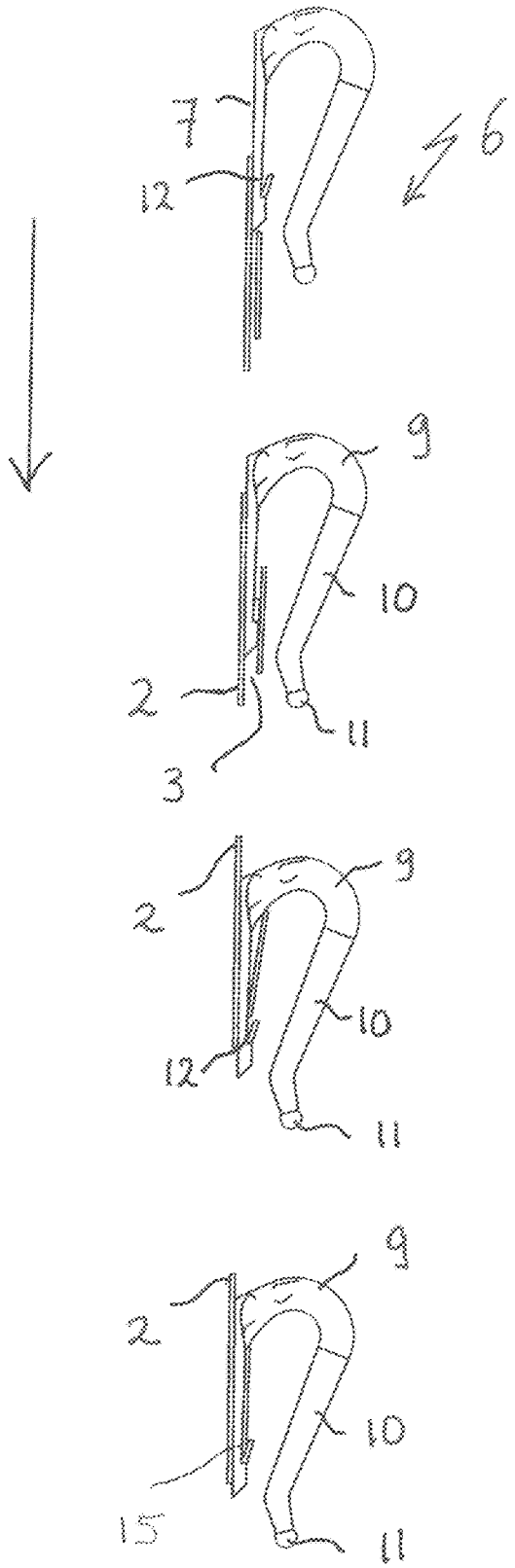

The invention will be further elucidated on the basis of figures shown in a drawing, wherein FIGS. 1A through 1F show various views of a so-called wave curtain to which several panel hooks according to a preferred variant of the invention are connected;

FIGS. 2A through 2F show various views of the panel hook used in the wave curtain of FIGS. 1A through 1F; and FIG. 3 shows in steps, in side view, how the panel hook of FIGS. 2A through 2F is slid into a pocket of a panel.

FIGS. 1A through 1F show a so-called wave curtain 1 to which a tape 2 with pockets 3 is attached. Pockets 3 with a width of for instance 1 centimetre are arranged at a regular distance from each other in the tape 2, particularly manufactured from woven plastic. Pockets 3 are woven at a mutual distance by arranging a strip 4 on the tape 2. Panel hooks 6 according to the invention can be inserted into the pockets 3.

FIGS. 2A through 2F show various views of a panel hook or wave hook 6 used in FIGS. 1A through 1F. Panel hook 6 is manufactured from a piece of plastic and is constructed from a flat, stable foot which serves as panel fastening element 7 (as will be elucidated further hereinbelow), and from a hook element 8 provided with a hook bend 9 and a hook shank 10 with a knob 11 for hooking the wave curtain onto the rail in simple and safe manner. As drawn, the panel fastening element 7 comprises two outer ends: situated at a first outer end is the hook element 8 and situated at a second outer end lying opposite the first outer end is a barb 12. The foot, i.e. panel fastening element 7, is configured to fasten curtain 1 to panel hook 6 by arranging panel fastening element 7 in the pocket 3 of curtain 1 in an arranging direction (indicated with the arrow). A distance between a free outer end 13 of barb 12 and the first outer end is chosen such that it is at least the same as the dimension of the pocket 3 in the arranging direction. This results in the panel hook 6 being suspended in the pocket 3 at the position of a notch 15 formed by barb 12 and panel fastening element 7, wherein reference is made to FIG. 3. A wall of the pocket 3 is preferably clamped (after the panel fastening element 7 has been arranged) between barb 12 and hook element 8, i.e. is arranged therebetween in clicking or snapping manner. In other words, the panel fastening element 7 is then slid into the pocket 3 in one longitudinal movement in the arranging direction, such that the wall of the pocket 3 is then confined between the barb 12 and the hook element 8. This makes it possible to mount the panel fastening element 7 in the pocket 3 in reliable manner in a simple and controlled movement, either manually or mechanically. As shown in FIGS. 2A through 2F particularly in FIGS. 2D and 2F, the hook element 8 comprises, in a part thereof between the foot 7 and the hook bend 9, engaging means in the form of two recesses 14 arranged opposite each other in order to enable the panel hook 6 to be engaged there mechanically (in centring manner) and then be inserted into the pocket 3 mechanically.

As drawn, the barb 12 is directed toward the hook element 8 and extends in a direction obliquely opposite to the arranging direction. The panel fastening element 7 is elongate and extends parallel to the insertion direction.

FIG. 3 shows in steps, in side view, how the panel hook 6 of FIGS. 1A through 1F and 2A through 2F is slid into the pocket 3 of the panel 1 in the direction of the arrow. Parts corresponding to those of FIGS. 1A through 1F and 2A through 2F are designated with the same reference numerals. It can be clearly seen that, at the position of the notch 15 formed by the barb 12 and the panel fastening element 7 of the panel hook, the panel hook 6 is fastened in suspended manner in the pocket 3 of the panel 1 in its final position (at the bottom of FIG. 3).

The invention is not limited to the drawn embodiment, but also extends to other preferred variants falling within the scope of the appended claims.

The invention claimed is:

1. A panel hook configured to hook a panel to a carrier, the panel hook comprising:

a foot configured to fasten the panel to the panel hook when the foot is disposed in a pocket of the panel in an arranging direction; and a hook element arranged on a first outer end of the foot and configured to hook the panel hook onto the carrier, the hook element including a hook shank and a hook bend, the hook bend disposed between the hook shank and the foot, and a barb arranged at a second outer end of the foot, the second outer end lying opposite the first outer end, wherein the barb is oriented at an oblique angle with respect to the foot and is configured such that a distance between a free outer end of the barb and the first end of the foot is at least the same as the dimension of the pocket in the arranging direction;

wherein the hook shank has an axis such that a distal portion of the hook shank is closer to the foot than a proximal portion of the hook shank;

wherein the foot is substantially flat and has a width, and the barb is substantially flat and extends over the entire width of the foot;

wherein a portion of the hook element between the foot and the hook bend includes a pair of arcuate recesses disposed on opposite outer side surfaces of the hook, the recesses constituting a reduced thickness section of the hook element therebetween; and wherein the hook element has a width at the foot that is the same as the width of the foot, and a diameter of the hook bend is smaller than the width of the foot.

2. The panel hook according to claim 1, wherein the barb is directed toward the hook element and extends in a direction opposite to the arranging direction.

3. The panel hook according to claim 1, wherein the foot is configured to be arranged with respect to a wall of the pocket such that the wall is confined between the barb and the hook element.

4. The panel hook according to claim 1, wherein the foot is elongate and extends parallel to the arranging direction.

5. The panel hook according to claim 1, wherein the hook element extends beyond the barb.

6. The panel hook according to claim 1, wherein the foot and the hook element are manufactured integrally.

7. The panel hook according to claim 6, wherein the foot and the hook element are manufactured from a piece of plastic.

8. The panel hook according to claim 1, wherein the barb is oriented at the oblique angle to form a continuous notch where the respective flat surfaces of the barb and the foot meet along the width of the foot.

* * * * *